US008977170B2

(12) United States Patent
Wakimoto

(10) Patent No.: US 8,977,170 B2
(45) Date of Patent: Mar. 10, 2015

(54) IMAGE FORMING APPARATUS, TONER CASE AND DRIVE TRANSMISSION MECHANISM

(71) Applicant: Kyocera Document Solutions Inc., Osaka (JP)

(72) Inventor: Atsuhiro Wakimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/033,171

(22) Filed: Sep. 20, 2013

(65) Prior Publication Data

US 2014/0086639 A1 Mar. 27, 2014

(30) Foreign Application Priority Data

Sep. 25, 2012 (JP) ..... 2012-210312

(51) Int. Cl.
*G03G 15/08* (2006.01)
*G03G 21/16* (2006.01)
*G03G 21/18* (2006.01)

(52) U.S. Cl.
CPC ..... *G03G 21/1676* (2013.01); *G03G 21/186* (2013.01)
USPC ..... 399/258

(58) Field of Classification Search
CPC ..... G03G 21/1676; G03G 21/186
USPC ..... 399/119, 254, 256, 258, 262, 263
See application file for complete search history.

(56) References Cited

U.S. PATENT DOCUMENTS

| | | | | |
|---|---|---|---|---|
| 7,747,200 | B2 | 6/2010 | Eto | |
| 2007/0077101 | A1 * | 4/2007 | Tamura et al. | 399/262 |
| 2012/0195641 | A1 * | 8/2012 | Huck et al. | |
| 2012/0281999 | A1 * | 11/2012 | Chadani et al. | |

FOREIGN PATENT DOCUMENTS

| | | | |
|---|---|---|---|
| JP | H08-270642 | A | 10/1996 |
| JP | 2003-287050 | A | 10/2003 |

(Continued)

OTHER PUBLICATIONS

An Office Action; "Notice of Reasons for Rejection," issued by the Japanese Patent Office on Sep. 16, 2014, which corresponds to Japanese Patent Application No. 2012-210312 and is related to U.S. Appl. No. 14/033,171.

(Continued)

*Primary Examiner* — Susan Lee
(74) *Attorney, Agent, or Firm* — Studebaker & Brackett PC

(57) ABSTRACT

An image forming apparatus includes a toner case containing a toner and an installed member in which the toner case is installed. The toner case has a case main body in which rotating members are installed, and a following coupling. The case main body has a discharge port discharging the toner. The following coupling is connected to the rotating member and has a pressured part. The installed member has a drive coupling and a drive source rotating the drive coupling. The drive coupling is linked to the following coupling and has a pressuring part. The drive coupling and following coupling are rotated in the same rotation direction around the same rotation axis by pressuring the pressured part by the pressuring part. The pressured part is provided so as to come close to the rotation axis from an upper stream side to a lower stream side in the rotation direction.

19 Claims, 13 Drawing Sheets

(56) References Cited

FOREIGN PATENT DOCUMENTS

| | | | |
|---|---|---|---|
| JP | 2004-108481 | A | 4/2004 |
| JP | 2005-076734 | A | 3/2005 |
| JP | 2008-040377 | A | 2/2008 |
| JP | 2010-026195 | A | 2/2010 |
| JP | 2010-032754 | A | 2/2010 |
| JP | 2012-027505 | A | 2/2012 |

OTHER PUBLICATIONS

An Office Action; "Notice of Reason for Rejection," issued by the Japanese Patent Office on Jan. 6, 2015, which corresponds to Japanese Patent Application No. 2012-210312 and is related to U.S. Appl. No. 14/033,171.

* cited by examiner

IMAGE FORMING APPARATUS, TONER CASE AND DRIVE TRANSMISSION MECHANISM

INCORPORATION BY REFERENCE

This application is based on and claims the benefit of priority from Japanese Patent application No. 2012-210312 filed on Sep. 25, 2012, the entire contents of which are incorporated herein by reference.

BACKGROUND

The present disclosure relates to an image forming apparatus, a toner case installed in the image forming apparatus and a drive transmission mechanism installed in the image forming apparatus.

An electrographic image forming apparatus carries out the development process by supplying a toner (a developer) from a development device to an electrostatic latent image formed on the surface of a photosensitive drum or the like. The toner used in such development process is supplied from a toner case, such as a toner container or an intermediate hopper, to the development device. The above-mentioned toner case includes a case main body having a discharge port discharging the toner, a rotating member (e.g. an agitating paddle and a conveying screw) rotatably installed in the case main body and a following coupling connected to the rotating member. The rotating member is rotated by linking the above-mentioned following coupling to a drive coupling connected to a drive source, such as a motor.

For example, there is a configuration linking the drive coupling including a triangle-formed hole and following coupling including a triangle pole-formed protrusion. Alternatively, there is another configuration that the drive coupling and following coupling are formed in twisted-shapes. Moreover, there is a further configuration that the drive coupling and following coupling are formed to have tapered faces.

However, in the configuration linking the drive coupling including the triangle-formed hole and following coupling including the triangle pole-formed protrusion, in a case where a drive torque of the following coupling is large, there is a possibility that the linkage of the drive coupling and following coupling is accidentally released. As the case where the drive torque of the following coupling is large, for example, there are a case where a residual quantity of the toner in the toner case is large and a case where the toner in the toner case is solidified.

On the other hand, in the other configuration having the twisted-formed drive coupling and following coupling or the further configuration having the drive coupling and following coupling provided with the tapered faces, it is to some extent possible to prevent the linkage of the drive coupling and following coupling from being accidentally released. However, if the above-mentioned configurations are applied, shapes of the couplings are complicated, and accordingly, shapes of molds molding the couplings are also complicated. Therefore, in a case where it is desired to provide incompatibility of the couplings or other cases, it is difficult to mold the couplings in various shapes with maintaining the simple mold design.

SUMMARY

In accordance with an embodiment of the present disclosure, an image forming apparatus includes a toner case and an installed member. The toner case contains a toner. The toner case has a case main body, one or more rotating members and a following coupling. The case main body has a discharge port discharging the toner. The rotating members are rotatably installed in the case main body. The following coupling is connected to the rotating member and configured to have a pressured part. In the installed member, the toner case is attachably/detachably installed. The installed member has a drive coupling and a drive source. The drive coupling is linked to the following coupling and configured to have a pressuring part. The drive source rotates the drive coupling. The drive coupling and following coupling are rotated in the same rotation direction around the same rotation axis by pressuring the pressured part by the pressuring part. The pressured part is provided so as to come close to the rotation axis from an upper stream side to a lower stream side in the rotation direction.

Moreover, in accordance with an embodiment of the present disclosure, a toner case contains a toner and is attachably/detachably installed in an installed member so as to be provided in an image forming apparatus together with the installed member. The toner case includes a case main body, one or more rotating members and a following coupling. The case main body has a discharge port discharging the toner. The rotating members are rotatably installed in the case main body. The following coupling is connected to the rotating member and configured to have a pressured part. The installed member has a drive coupling and a drive source. The drive coupling is linked to the following coupling and configured to have a pressuring part. The drive source rotates the drive coupling. The drive coupling and following coupling are rotated in the same rotation direction around the same rotation axis by pressuring the pressured part by the pressuring part. The pressured part is provided so as to come close to the rotation axis from an upper stream side to a lower stream side in the rotation direction.

Furthermore, in accordance with an embodiment of the present disclosure, a drive transmission mechanism is provided in an image forming apparatus. The drive transmission mechanism includes a following coupling and a drive coupling. The following coupling is connected to one or more rotating members and configured to have a pressured part. The drive coupling is linked to the following coupling and configured to have a pressuring part. The drive coupling and following coupling are rotated in the same rotation direction around the same rotation axis by pressuring the pressured part by the pressuring part. The pressured part is provided so as to come close to the rotation axis from an upper stream side to a lower stream side in the rotation direction.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
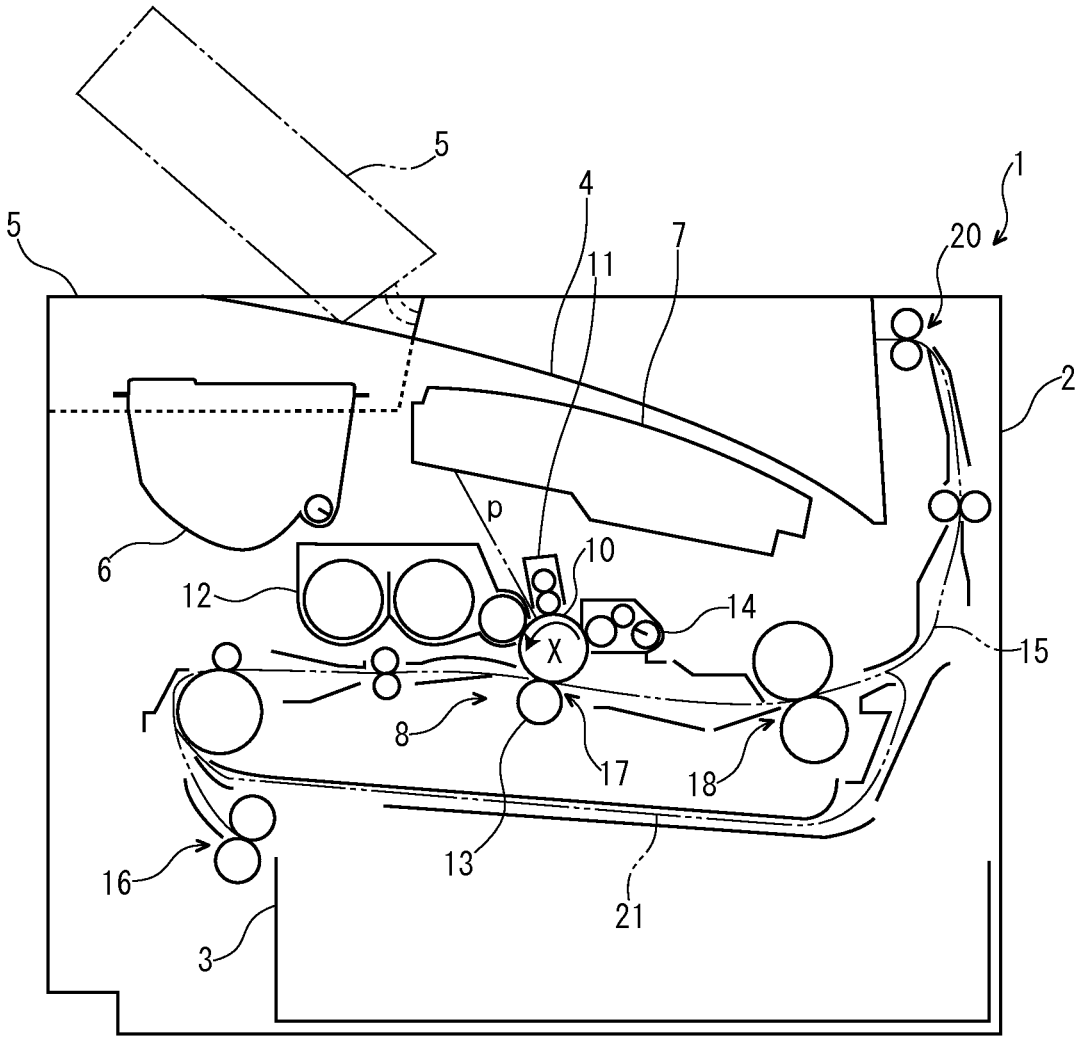
FIG. 1 is a schematic diagram schematically showing a printer according to an embodiment of the present disclosure.

First, with reference to FIG. 1, the entire structure of an electrographic printer (an image forming apparatus) 1 will be described. FIG. 1 is a schematic diagram schematically showing the printer according to an embodiment of the present disclosure. Hereinafter, it will be described so that the front side of the printer 1 is positioned at the left-hand side of FIG. 1.

The printer 1 includes a box-formed printer main body 2. In a lower part of the printer main body 2, a sheet feeding cartridge 3 configured to store sheets (not shown) is installed and, on the top surface of the printer main body 2, an ejecting tray 4 is mounted. On the top surface of the printer main body 2, an upper cover 5 is openably/closably attached in front of the sheet ejecting tray 4 and, below the upper cover 5, a toner container (a toner case) 6 containing a toner (a developer) is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device (an installed member) 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to a two-dot chain line P in FIG. 1) from the exposure device 7, thereby forming an electrostatic latent image on the surface of the photosensitive drum 10. Subsequently, the electrostatic latent image is developed to a toner image with the toner in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Figure 2:
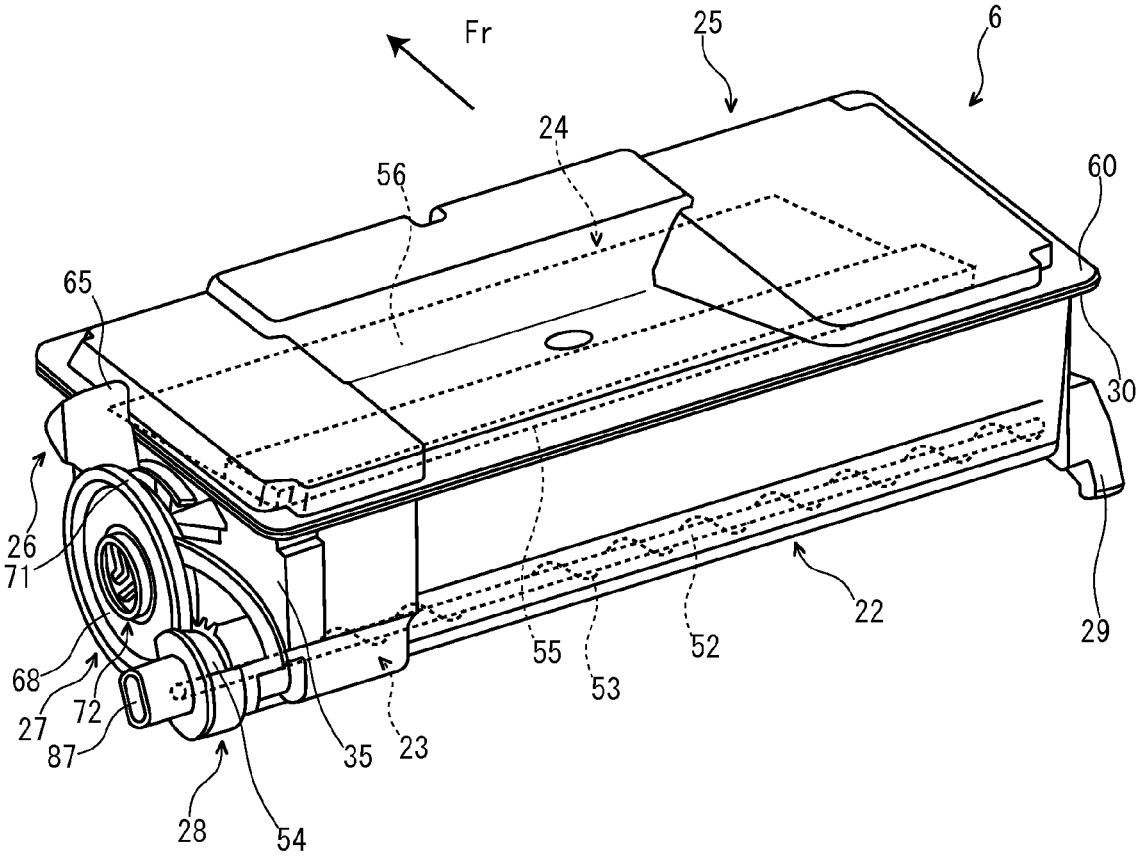
FIG. 2 is a back right perspective view showing a toner container in the printer according to the embodiment of the present disclosure.
Figure 3:
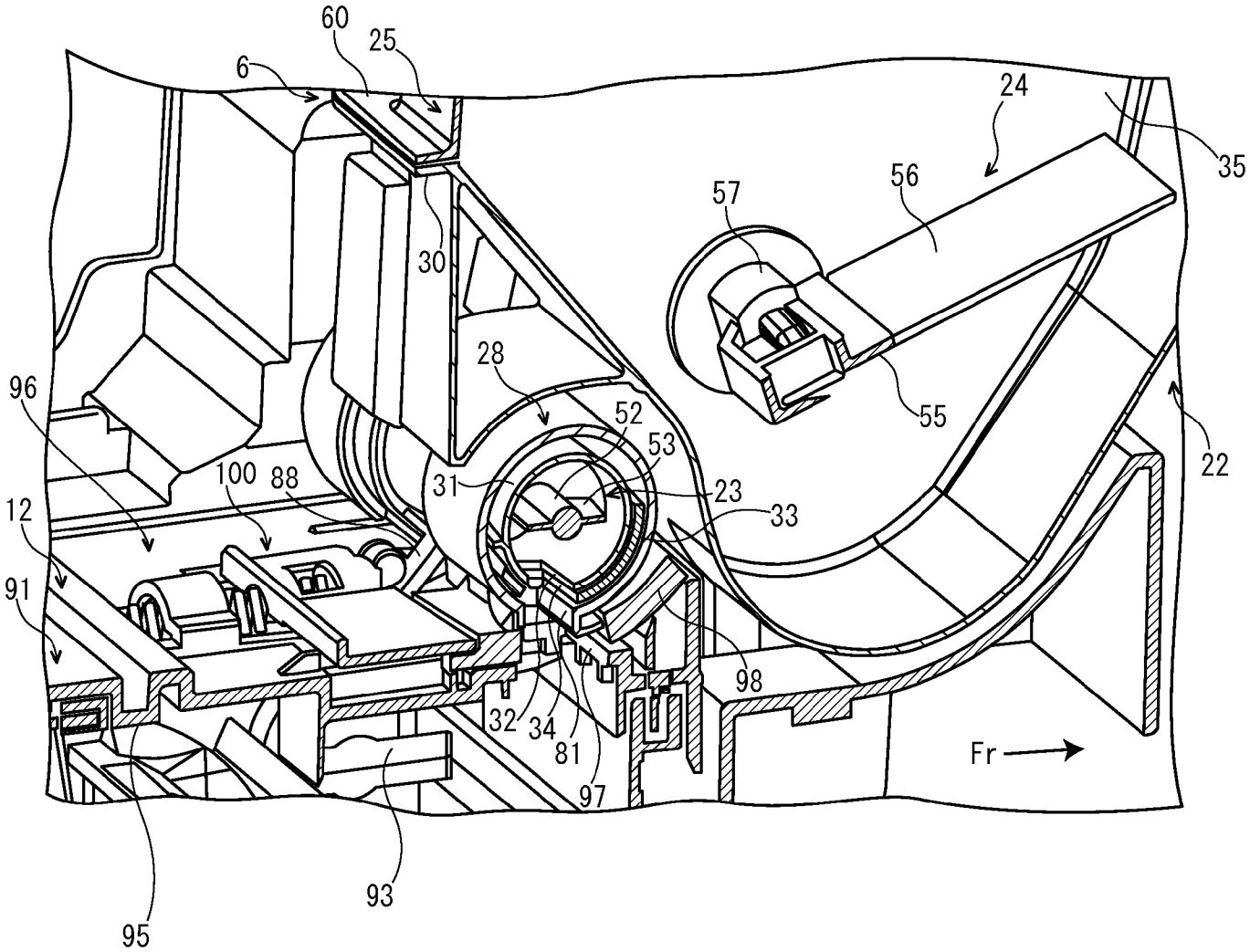
FIG. 3 is a back left perspective sectional view showing the printer in a situation, in which a case side shutter opens a discharging port and a development device side shutter opens a replenishing port, according to the embodiment of the present disclosure.

Next, with reference to FIGS. 2-5, the toner container 6 will be described in detail. Arrow Fr suitably put on each figure indicates the front side of the printer 1 (similarly, in FIG. 6 and later). FIG. 2 is the back right perspective view and FIG. 3 is the back left perspective sectional view. Therefore, with regard to FIGS. 2 and 3, the left-hand and right-hand sides of the figure are converse to the actual left-hand and right-hand sides.

As shown in FIG. 2, the toner container 6 includes a box-formed case main body 22 with a opened top face, a conveying screw (a rotating member) 23, an agitating paddle (another rotating member) 24, a covering body 25, a lever 26, a transmitting member 27 and a case side shutter 28. The conveying screw 23 is installed in a lower rear part of the case main body 22. The agitating paddle 24 is installed near a center part of the case main body 22. The covering body 25 covers the top face of the case main body 22. The lever 26 is attached to a right end part of the case main body 22. The transmitting member 27 is placed on the right end part of the case main body 22 together with the lever 26. The case side shutter 28 is attached on the lower rear part of the right end part of the case main body 22. Hereinafter, these components are described in order.

First, the case main body 22 will be described. The case main body 22 is formed in an elongated-shape in left and right directions to contain the toner. On a lower rear part of a left end wall (not shown) of the case main body 22, a locking piece 29 is formed. On the circumference of a top end of the case main body 22, a main body side flange 30 is formed.

As shown in FIG. 3, at the right bottom end part of the case main body 22, a cylinder-formed discharge duct 31 is protruded to the right side. In a bottom part of the discharge duct 31, a discharge port 32 discharging the toner is bored. On the circumference of a lower part of the discharge duct 31, a case side sealing member 33 is attached and, in the case side sealing member 33, a communication port 34 is bored at a correspondent position to the discharge port 32.

Figure 4:
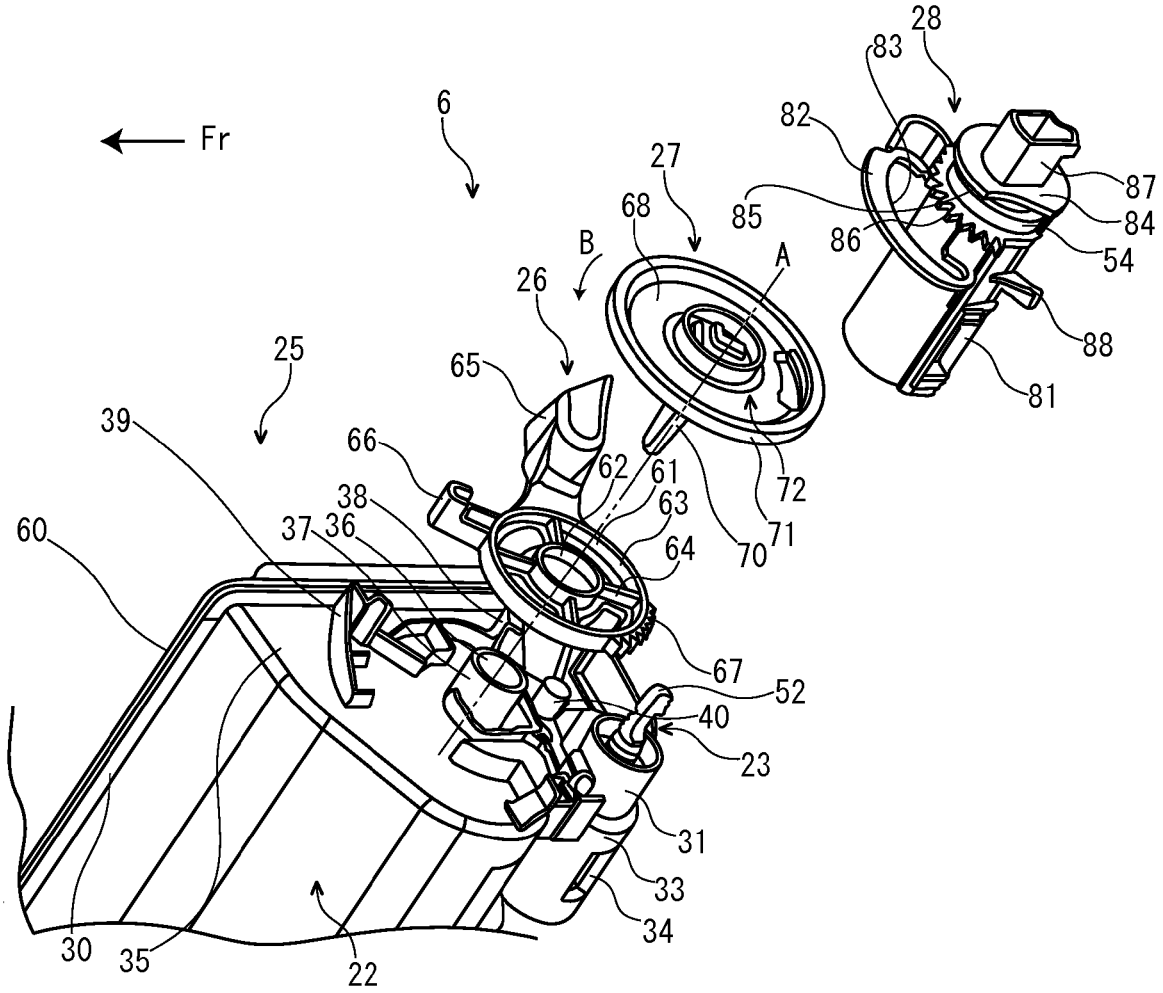
FIG. 4 is an exploded perspective view showing the toner container in the printer according to the embodiment of the present disclosure.

As shown in FIG. 4, at the center of a right end wall 35 of the case main body 22, a cylinder-formed boss 37 having an insertion hole 36 is protruded to the right side (an outside direction). On a right face (an outer face) of the right end wall 35 of the case main body 22, a first restrain rib 38 is protruded above and in rear of the boss 37. On the right face of the right end wall 35 of the case main body 22, a second restrain rib 39 is protruded above and in front of the boss 37. On the right face of the right end wall 35 of the case main body 22, a columnar protrusion 40 is formed below the first restrain rib 38.

Next, the conveying screw 23 will be described. As shown in FIG. 2 and other figures, the conveying screw 23 is formed in an elongated-shape in the left and right directions and extended in the left and right directions in the case main body 22 (in a longitudinal direction of the case main body 22). The conveying screw 23 includes a bar-formed screw shaft 52 and a spiral fin 53 concentrically mounted on the circumference of the screw shaft 52. As shown in FIG. 3, right side parts of the screw shaft 52 and spiral fin 53 are inserted into the discharge duct 31 of the case main body 22. A right end part of the screw shaft 52 protrudes from the discharge duct 31 to the right side and, to the protruding part, a conveying gear 54 (refer to FIG. 2 and other figures) is fixedly attached.

Next, the agitating paddle 24 will be described. As shown in FIG. 2, the agitating paddle 24 is located above and in front of the conveying screw 23. The agitating paddle 24 is formed in an elongated-shape in the left and right directions and extended in the left and right directions in the case main body 22 (in the longitudinal direction of the case main body 22). The agitating paddle 24 includes a supporting frame 55 formed in a frame board liked-shape and a sheet-formed agitating fin 56 supported by the supporting frame 55. Left and right end parts of the supporting frame 55 are pivotally supported by the right end wall 35 and left end wall (not shown) of the case main body 22 via respective bearings 57 (refer to FIG. 3). Hereinafter, the bearing 57 is called as "a bearing 57 of an agitating paddle 24". The agitating fin 56 is made of, for example, plastic sheet, such as lumirror.

Next, the covering body 25 will be described. As shown in FIG. 2, on the circumference of the covering body 25, a covering body side flange 60 is formed in the correspondent form to the main body side flange 30 of the case main body 22. The main body side flange 30 and covering body side flange 60 are ultrasonic-welded together so that the case main body 22 and covering body 25 are unified.

Next, the lever 26 will be described. As shown in FIG. 4 and other figures, the lever 26 includes a lever main body 61 with a circular profile in aside view. The lever main body 61 includes a small-diameter cylinder 62, a large-diameter cylinder 63 attached around the circumference of the small-diameter cylinder 62 and four radially extended connecters 64 connecting the small-diameter cylinder 62 and large-diameter cylinder 63 with each other.

The small-diameter cylinder 62 is fitted onto the circumference of the boss 37 arranged on the right end wall 35 of the case main body 22. Accordingly, the lever 26 is rotatably supported onto the case main body 22. On an upper part of the large-diameter cylinder 63, a gripper 65 is protruded. On the large-diameter cylinder 63, a protruding piece 66 is formed in front of the gripper 65. On the circumference of a lower rear part of the large-diameter cylinder 63, a lever side gear 67 is formed.

Next, the transmitting member 27 will be described. As shown in FIG. 4 and other figures, the transmitting member 27 includes a disc-formed transmitting member main body 68. On a left face (an inner face) of the transmitting member main body 68, an engaging piece 70 is protruded. The engaging piece 70 is inserted into the insertion hole 36 formed in the boss 37 of the case main body 22, and then, engaged with the bearing 57 of the agitating paddle 24 (refer to FIG. 3). Accordingly, the transmitting member 27 and the agitating paddle 24 are connected to each other so as to rotate in a body.

As shown in FIG. 2 and other figures, on the circumference of the transmitting member main body 68, a transmission gear 71 is formed. The transmission gear 71 meshes with the conveying gear 54 fixed to the screw shaft 52 of the conveying screw 23 so that the conveying screw 23 is rotated accompanying to rotation of the transmitting member 27.

As shown in FIG. 4 and other figures, on a right face (an outer face) of the transmitting member main body 68, a following coupling 72 is formed. The following coupling 72 is connected to the conveying screw 23 and agitating paddle 24. A two-dot chain line A in FIG. 4 and a point A in FIG. 5B indicate a center of rotation of the following coupling 72. Hereinafter, this is called as a "rotation axis A". Arrows B in FIG. 4, FIG. 5A and FIG. 5B indicate a direction of the rotation of the following coupling 72. Hereinafter, this is called as a "rotation direction B".

Figure 5A:
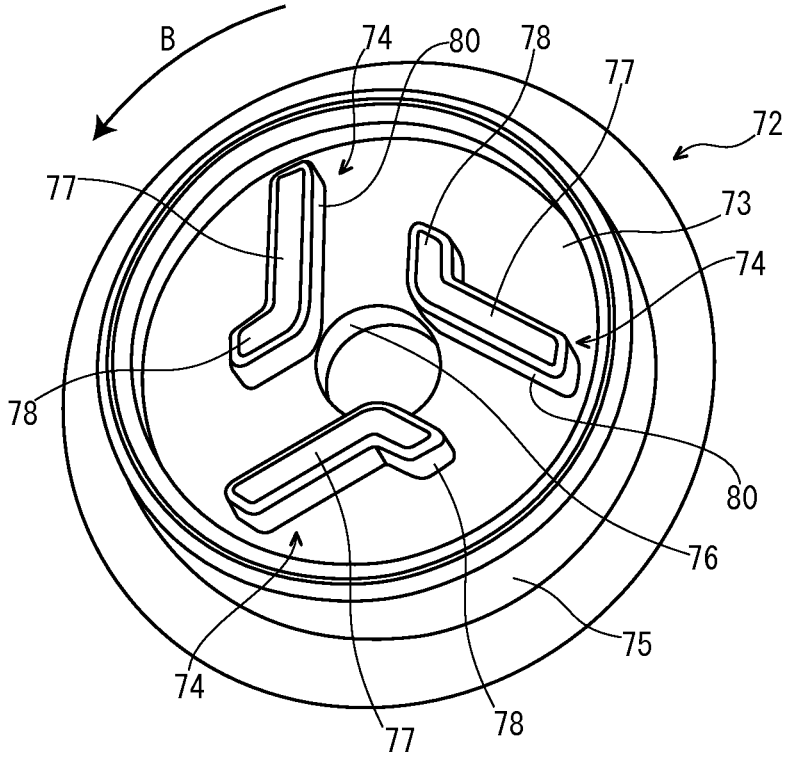
FIG. 5A is a perspective view showing a following coupling in the toner container of the printer according to the embodiment of the present disclosure.

As shown in FIG. 5A, the following coupling 72 includes a flat board-formed supporting face 73, three following protrusions 74 and an annular flange 75. The following protrusions 74 are protruded from the supporting face 73. The flange 75 is protruded from the supporting face 73 to surround each following protrusion 74. The supporting face 73 is formed perpendicular to the rotation axis A. At the center of the supporting face 73, a round hole 76 is bored.

Figure 5B:
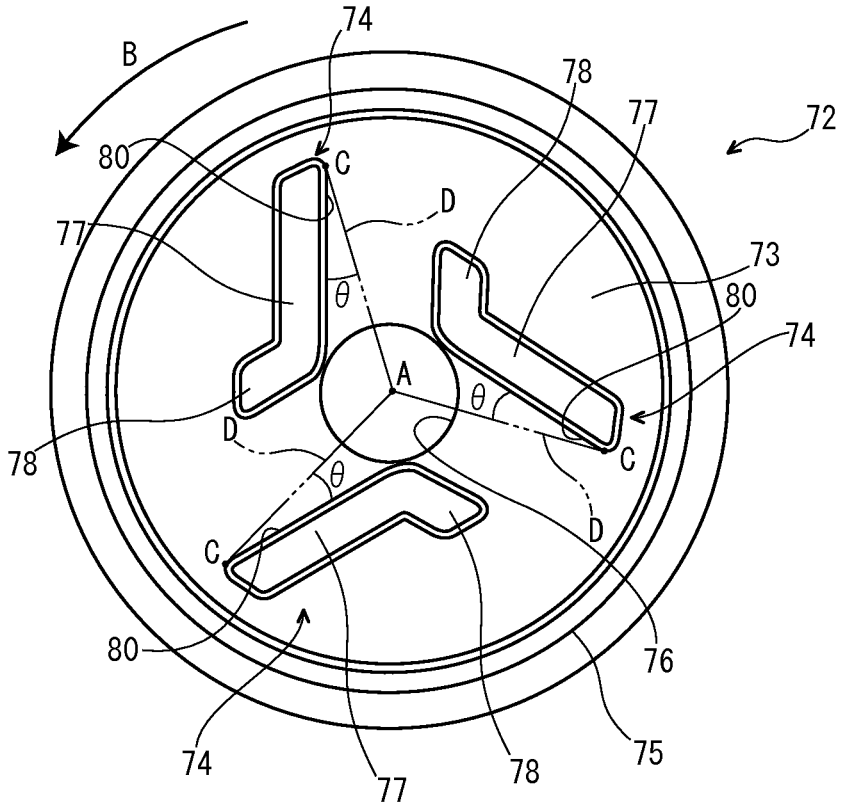
FIG. 5B is a right side view showing the following coupling in the toner container of the printer according to the embodiment of the present disclosure.

Each following protrusion 74 includes an extended part 77 extending linearly and a bend part 78 bent from one end part (an inside end part in the embodiment) in the longitudinal direction of the extended part 77 to a lower stream side in the rotation direction B. The following protrusion 74 is formed in a roughly L-shape. In the extended part 77 of each following protrusion 74, a pressured part 80 is formed on a face at an upper stream side in the rotation direction B. As shown in FIG. 5B, the pressured part 80 is provided so as to come close to the rotation axis A gradually from the upper stream side to a lower stream side in the rotation direction B. The pressured part 80 is inclined with respect to a standard line D connecting the rotation axis A to an upper stream end part C of the pressured part 80. An angle θ of the pressured part 80 to the standard line D is, for example, $5 \leq \theta \leq 10$ degree. The pressured part 80 faces to the standard line D connecting the rotation axis A to an upper stream end part C of the pressured part 80. The pressured part 80 is provided for each of the following protrusions 74, that is, three pressured parts 80 in total are provided. The pressured parts 80 are located at intervals of equal angle (120 degree).

The flange 75 is located at a predetermined distance from another end part (an outside end part in the embodiment) in the longitudinal direction of the extended part 77 of each following protrusion 74. Projection height of the flange 75 from the supporting face 73 is equal to projection height of the following protrusion 74 from the supporting face 73.

Next, the case side shutter 28 will be described. As shown in FIG. 4, the case side shutter 28 is formed in a cylinder-liked shape. The case side shutter 28 is rotatably fitted onto the circumference of the discharge duct 31 of the case main body 22. In a lower face of the case side shutter 28, a discharge aperture 81 is bored. As shown in FIG. 3, the discharge aperture 81 is formed at a correspondent position to the discharge port 32 of the case main body 22 and the communication port 34 of the sealing member 33.

As shown in FIG. 4, on the case side shutter 28, a roughly fan-formed guiding piece 82 is protruded. In the guiding piece 82, an arc-formed guiding hole 83 is formed and, with the guiding hole 83, the protrusion 40 of the case main body 22 is engaged.

In the case side shutter 28, a gear box 84 is provided and the gear box 84 houses the conveying gear 54. In the gear box 84, a communication aperture 85 is formed so that the conveying gear 54 can be housed in the gear box 84 via the communication aperture 85.

The case side shutter 28 is provided with a shutter side gear 86. The shutter side gear 86 meshes with the lever side gear 67 of the lever 26 so as to turn the case side shutter 28 in the opposite direction to the lever 26 accompanying to the turn of the lever 26. On the right end part of the case side shutter 28, a fixing piece 87 is provided. In a lower part of the case side shutter 28, a pressuring protrusion 88 is formed.

Next, with reference to FIGS. 6-11, the development device 12 will be described in detail.

Figure 6:
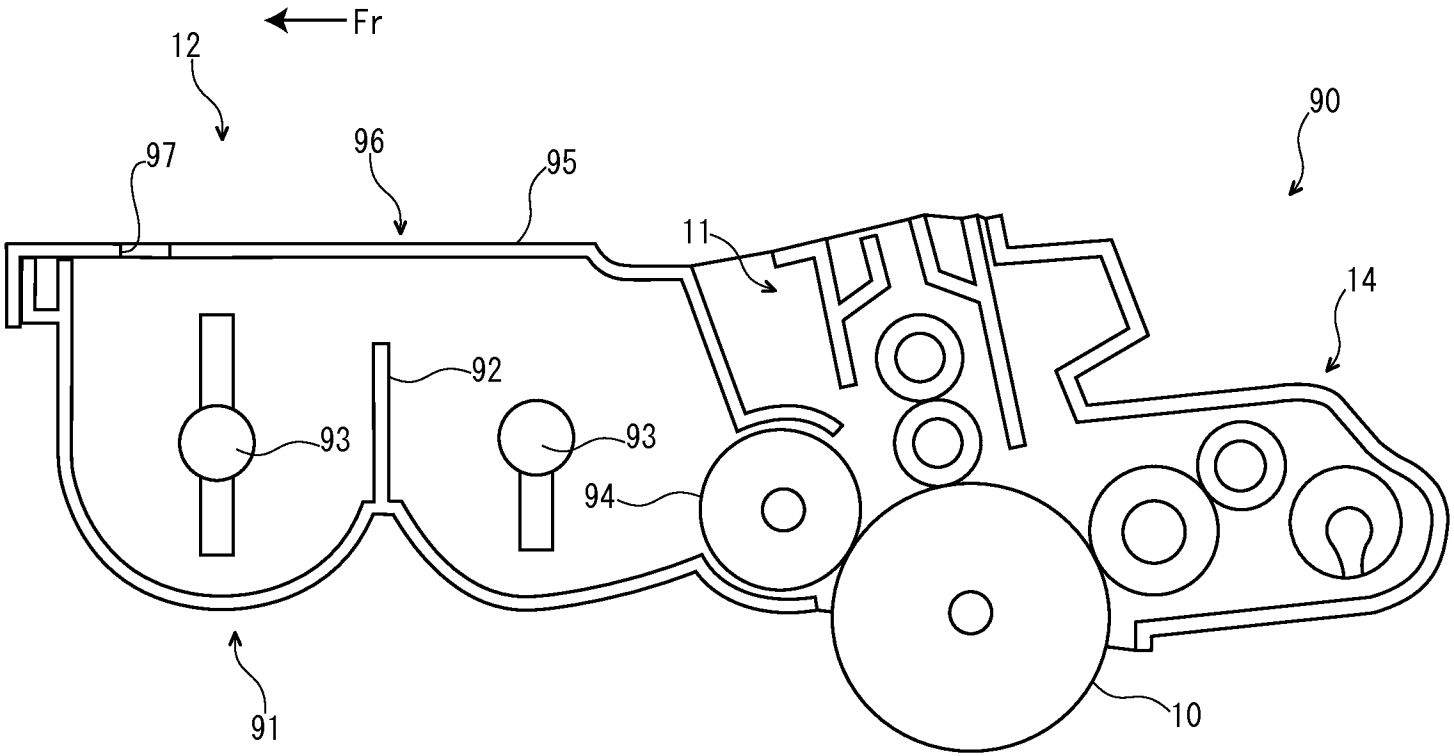
FIG. 6 is a schematic diagram showing an image forming unit in the printer according to the embodiment of the present disclosure.

As shown in FIG. 6, the development device 12 is integrated with the photosensitive drum 10, charger 11 and cleaning device 14, and thereby, an image forming unit 90 is composed. The image forming unit 90 is configured to be drawable in an upper forward direction from the printer main body 2 and to be attachable/detachable to the printer main body 2.

The development device 12 is provided with a box-formed development device main body 91. At the center inside the development device main body 91, a partition 92 extending in upper and lower directions is formed and, in front of and in rear of the partition 92, agitating members 93 are respectively installed. Each agitating member 93 is rotatably supported in the development device main body 91. Inside the development device main body 91, in rear of and below the rear agitating member 93, a developing roller 94 is installed. The developing roller 94 is rotatably supported in the development device main body 91 and comes into contact with the surface of the photosensitive drum 10.

Figure 7:
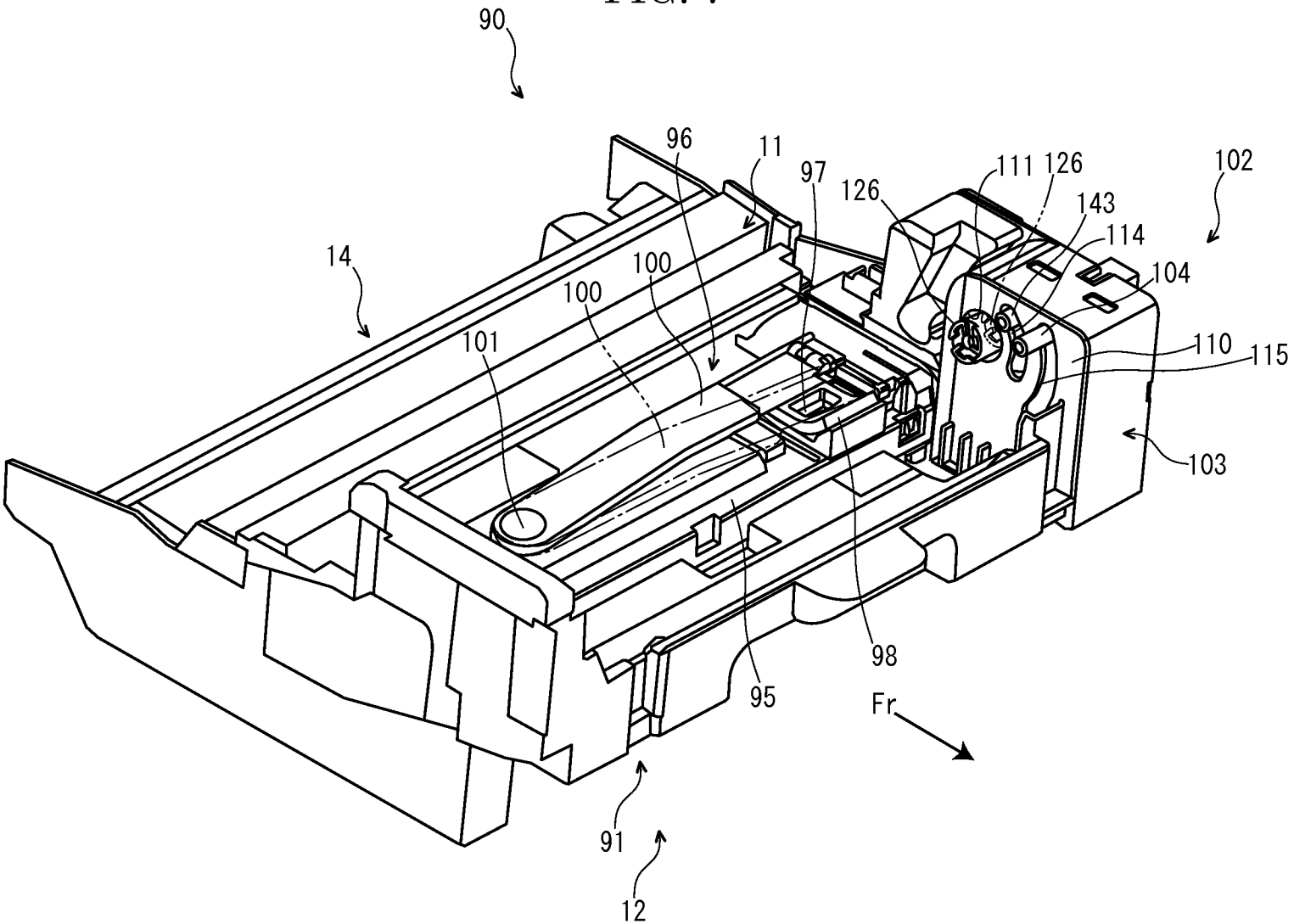
FIG. 7 is a front left perspective view showing the image forming unit in the printer according to the embodiment of the present disclosure.
Figure 8:
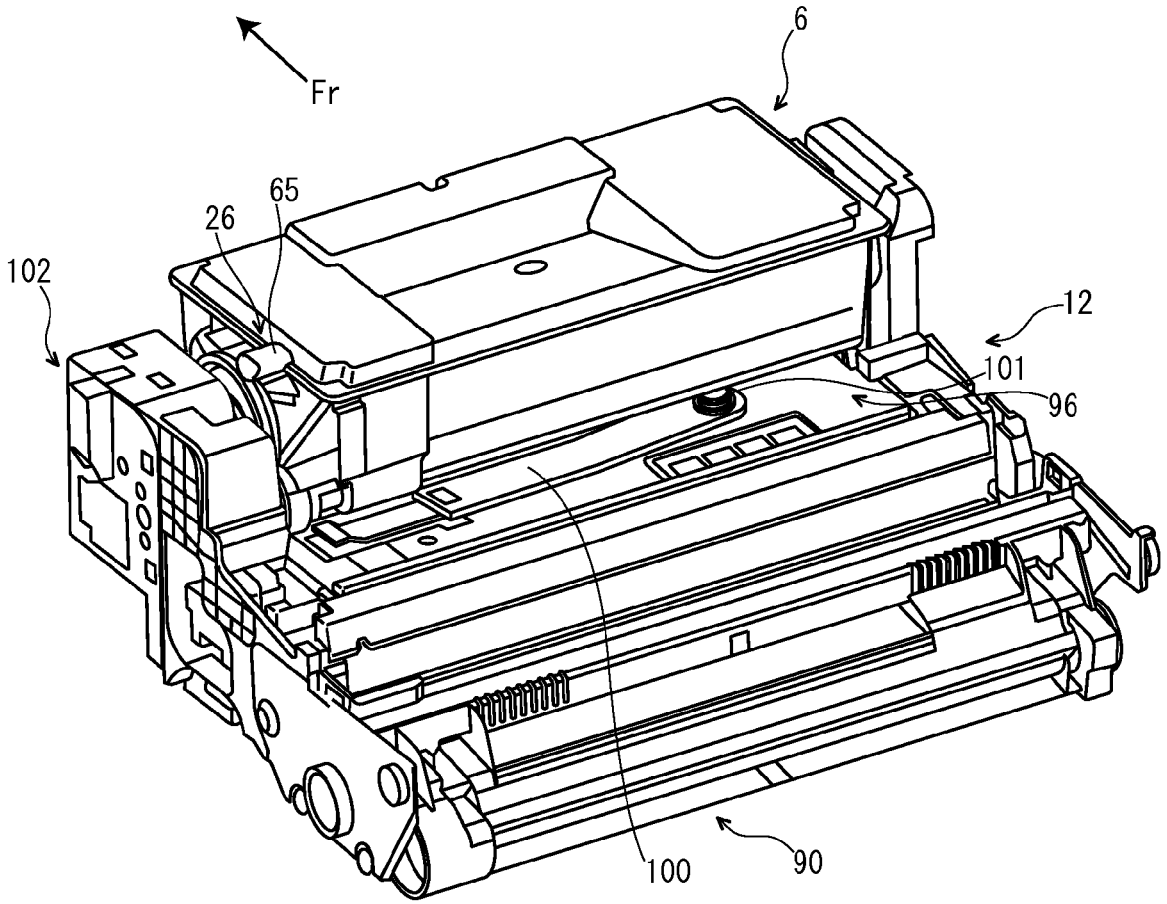
FIG. 8 is a back right perspective view showing the printer in a situation, in which the toner container is installed to a development device, according to the embodiment of the present disclosure.

As shown in FIG. 7, on the top face side of a top wall 95 of the development device main body 91, an installed part 96 is provided. In the installed part 96, the toner container 6 is attachably/detachably installed (refer to FIG. 8). In the top wall 95 of the development device main body 91, a replenishment port 97 is bored in the upper and lower directions and, around the replenishment port 97, a development device side sealing member 98 is fixedly attached.

As shown in FIG. 7, at the top face side of the top wall 95 of the development device main body 91, a development device side shutter 100 is attached. At a left end part of the development device side shutter 100, a supporting pivot 101 is provided so that the development device side shutter 100 turns around the supporting pivot 101 in a forward or backward direction, thereby opening or closing the replenishment port 97 of the development device main body 91 by the development device side shutter 100.

Figure 9:
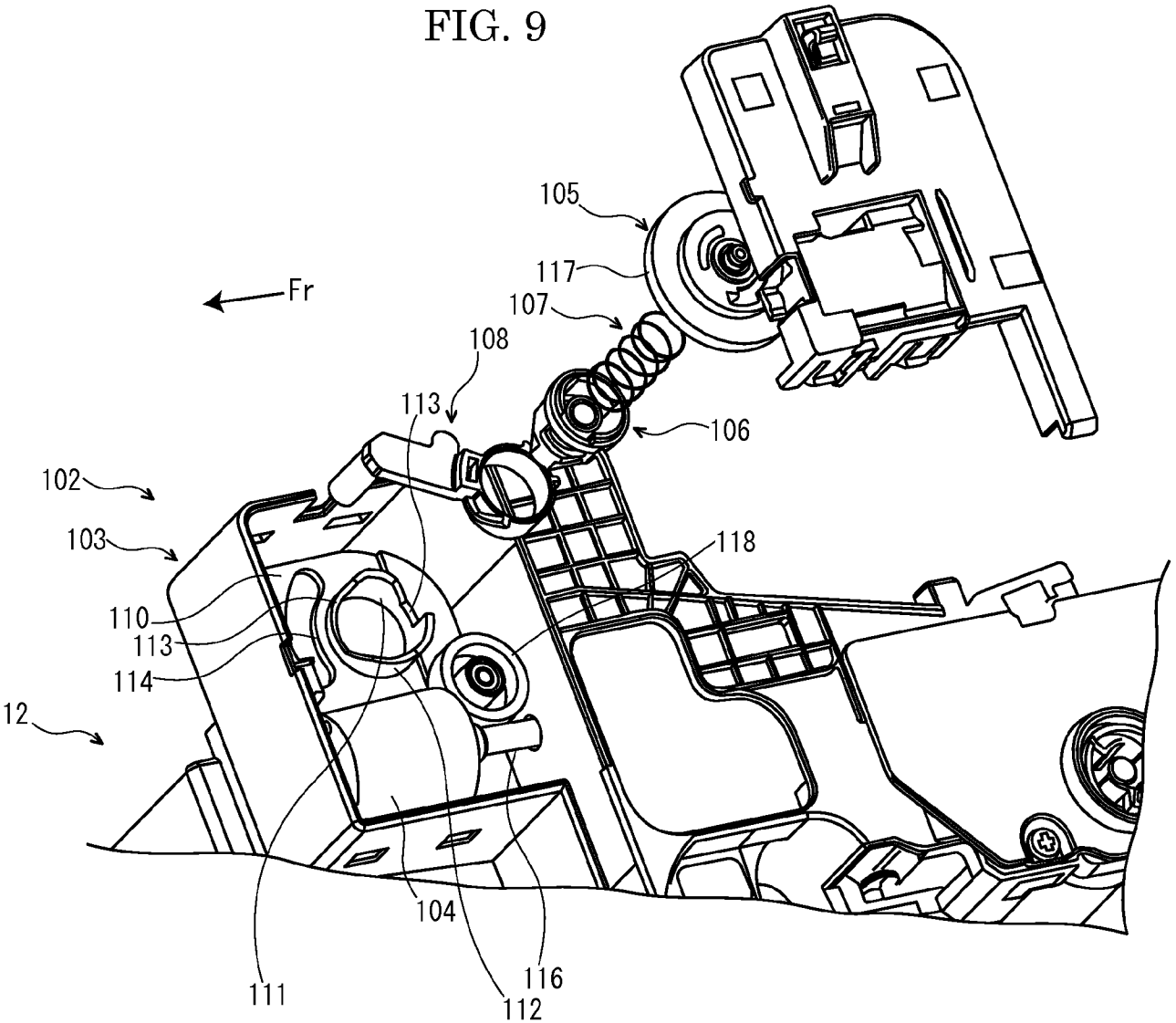
FIG. 9 is a front right explodedperspective view showing a drive mechanism in the development device of the printer according to the embodiment of the present disclosure.

At the right end side of the development device main body 91, a drive mechanism 102 is provided. As shown in FIG. 9, the drive mechanism 102 includes a box-formed casing member 103, a motor (a drive source) 104, a driving member 105, a moving member 106, a coil spring 107 and a pressuring member 108. The motor 104 is installed in a lower part of the casing member 103. The driving member 105 is installed in an upper part of the casing member 103. The moving member 106 is attached to the driving member 105. The coil spring 107 is installed between the driving member 105 and moving member 106. The pressuring member 108 is attached to the moving member 106. Hereinafter, these components are described in order.

First, the casing member 103 will be described. In an upper rear part of a left sideplate 110 of the casing member 103, a circular coupling insertion hole 111 is bored in the left and right directions. On a right face (an inner face) of the left side plate 110 of the casing member 103, a cylinder-formed insertion tube 112 is protruded from the circumference of the coupling insertion hole 111. A protruded end part of the insertion tube 112 is depressed so that a pair of engaging gaps 113 are formed. As shown in FIG. 7, in the left sideplate 110 of the casing member 103, a first insertion hole 114 is bored in the left and right directions in front of the coupling insertion hole 111. In the left side plate 110 of the casing member 103, a second insertion hole 115 is bored in the left and right directions in front of the first insertion hole 114.

Next, the motor 104 will be described. As shown in FIG. 9, to the motor 104, a worm gear 116 is fixedly attached. The motor 104 is connected with a motor driver (not shown) so that the motor 104 is driven by electric current from the motor driver.

Next, the driving member 105 will be described. On the circumference of the driving member 105, a driving gear 117 is formed and the driving gear 117 is connected to the worm gear 116 via an idle gear 118. Accordingly, when the motor 104 rotates, the rotation is transmitted to the driving member 105 via the worm gear 116 and driving gear 117, thereby rotating the driving member 105.

Figure 10:
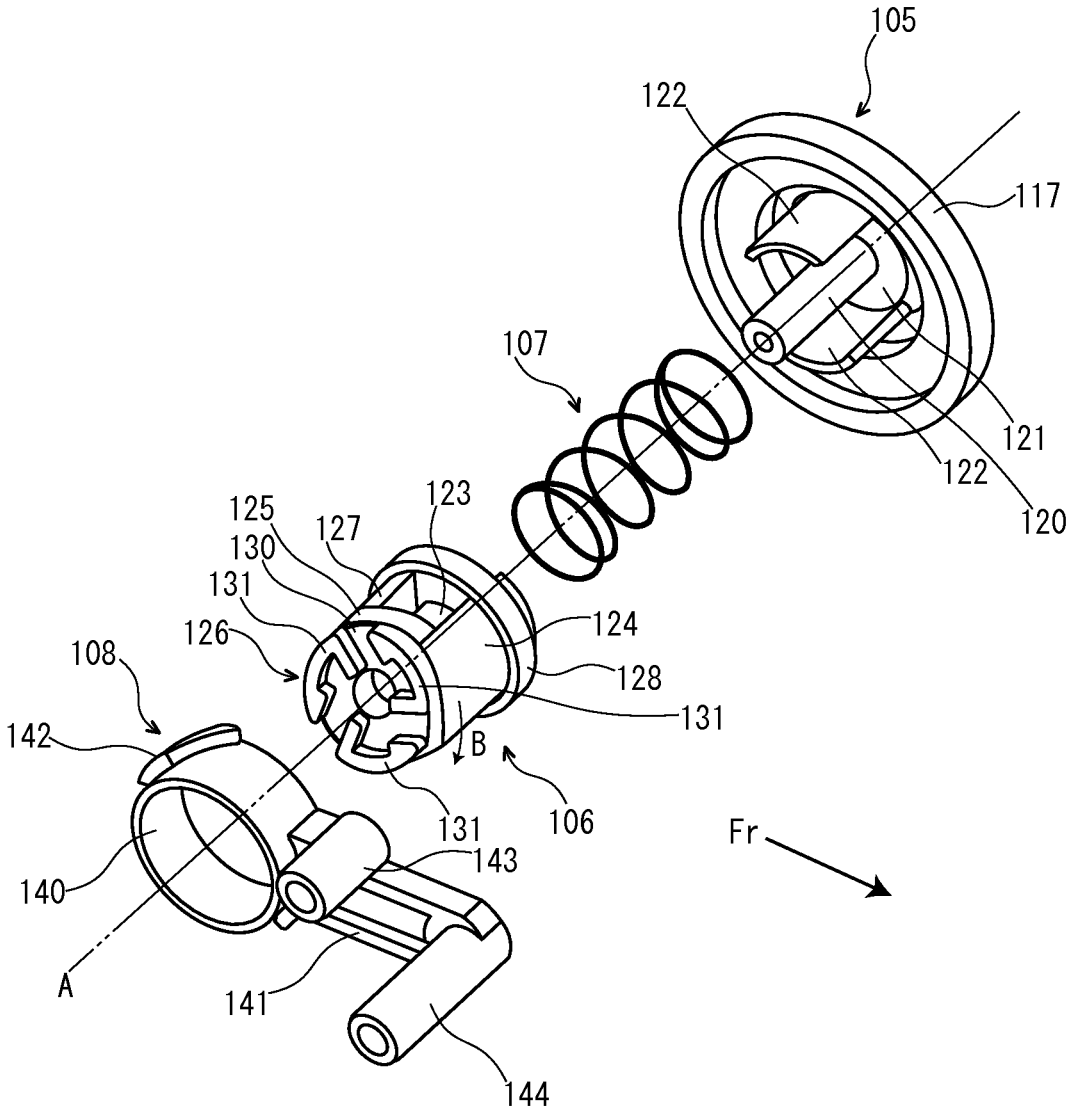
FIG. 10 is an exploded perspective view showing a driving member, a moving member, a coil spring and a pressuring member in the development device of the printer according to the embodiment of the present disclosure.

As shown in FIG. 10, at the center of the left side face of the driving member 105, a cylinder-formed insertion protrusion 120 is formed and, around the insertion protrusion 120, an annular spring contact face 121 is formed. From the circumference of the spring contact face 121, a pair of insertion plates 122 are protruded.

Next, the moving member 106 will be described. The moving member 106 includes a cylinder-formed inner tube 123, a cylinder-formed outer tube 124, an annular spring reception 125 and a drive coupling 126. The outer tube 124 is disposed around the inner tube 123. The spring reception 125 is adapted to connect the left end part of the inner tube 123 and the left end part of the outer tube 124 with each other. The drive coupling 126 is formed to the left face of the spring reception 125 in a body.

Figure 11A:
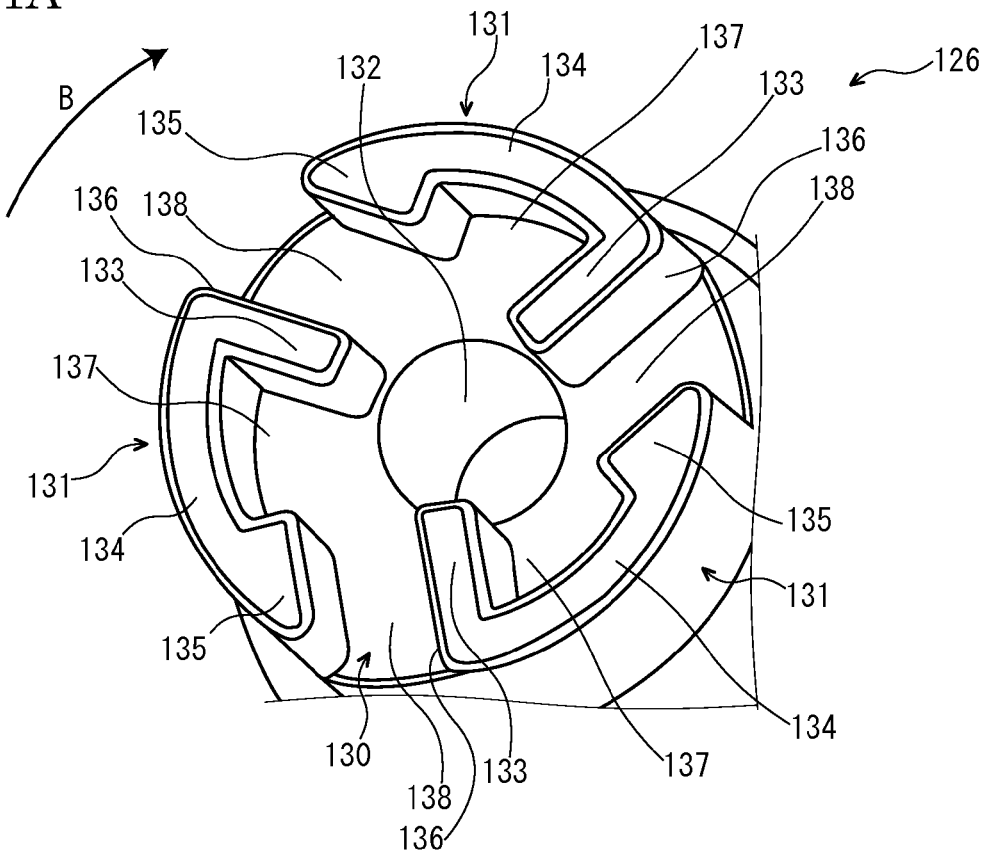
FIG. 11A is a perspective view showing a drive coupling in the development device of the printer according to the embodiment of the present disclosure.
Figure 11B:
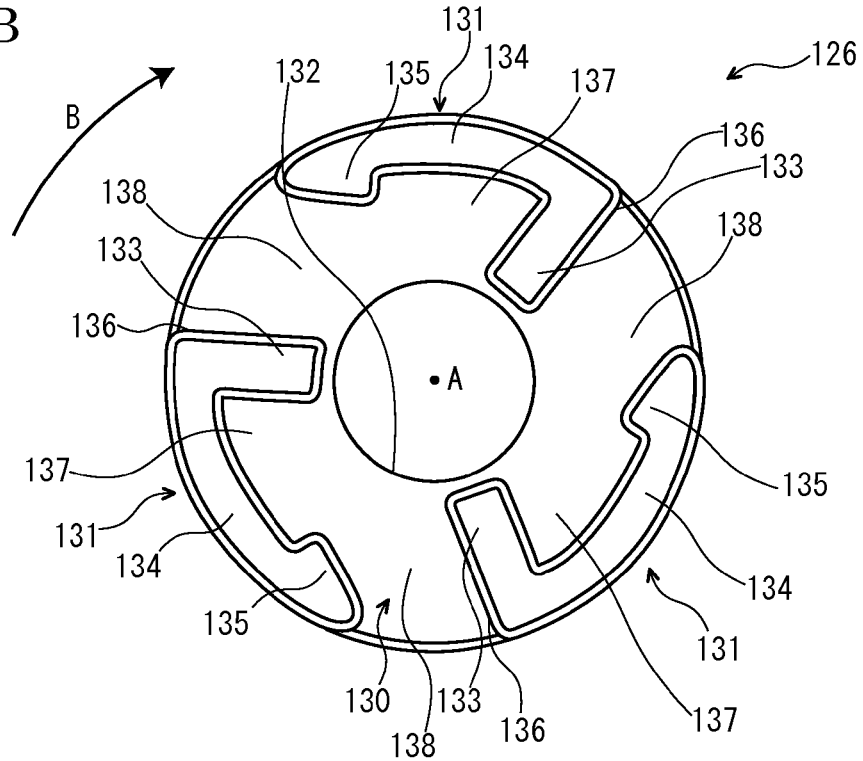
FIG. 11B is a left side view showing the drive coupling in the development device of the printer according to the embodiment of the present disclosure.

A two-dot chain line A in FIG. 10 and a point A in FIG. 11B indicate the above-mentioned rotation axis A. That is, the rotation axes of the following coupling 72 and drive coupling 126 are identical to each other. Arrows B in FIG. 10, FIG. 11A and FIG. 11B indicate the above-mentioned rotation direction B. That is, the rotation directions of the following coupling 72 and drive coupling 126 are identical to each other. The rotation directions B in FIGS. 5 and 11 are turned to opposite sides to each other, because FIG. 5 shows the following coupling 72 in a right view, but FIG. 11 shows the drive coupling 126 in a left view.

With reference to FIG. 10, in the inner tube 123, the insertion protrusion 120 of the driving member 105 is inserted. The outer tube 124 is depressed so that a pair of insertion gaps 127 are formed and, in the insertion gaps 127, the insertion plates 122 of the driving member 105 are inserted. Due to such a configuration, the moving member 106 can be rotated together with the driving member 105 in a body and be moved in the direction of the rotation axis A from the driving member 105. To the circumference of the right end of the outer tube 124, an annular ring 128 is fixedly attached.

Figure 12:
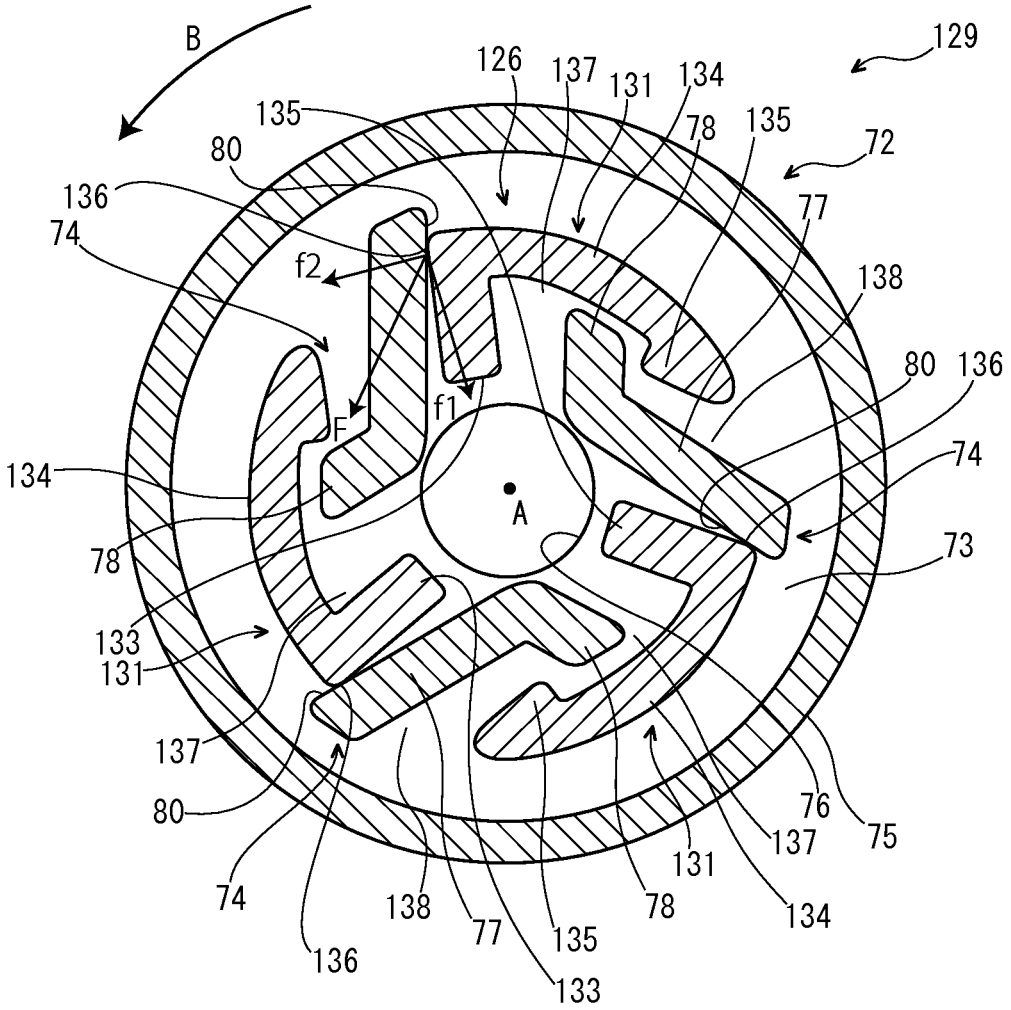
FIG. 12 is a sectional view showing the printer in a situation, in which the drive coupling is linked to the following coupling, according to the embodiment of the present disclosure.

As shown in FIG. 12, the drive coupling 126 together with the following coupling 72 composes a drive transmission mechanism 129. As shown in FIG. 11A, the drive coupling 126 includes a flat face 130 and three drive protrusions 131 protruded from the flat face 130. The flat face 130 is formed perpendicular to the rotation axis A. At the center of the flat face 130, a round hole 132 is bored in left and right directions.

As shown in FIG. 11B, each drive protrusion 131 includes a first arm part 133, a second arm part 134 and a hook part 135. The first arm part 133 linearly extends in a radial direction around the rotation axis A. The second arm part 134 is bent from an end part on the outside in the radial direction of the first arm part 133 to an upper stream side in the rotation direction B to curve in an arc form. The hook part 135 is bent from an upper stream end part of the second arm part 134 in the rotation direction B to the inside. In a boundary part between the first arm part 133 and second arm part 134, a pressuring part 136 is formed. The pressuring part 136 is provided for each of the drive protrusions 131, that is, three pressuring parts 136 in total are provided. The pressuring parts 136 are located at intervals of equal angle (120 degree). In a space surrounded by the first arm part 133, second arm part 134 and hook part 135, a depressed part 137 is formed. Between the hook 135 of one drive protrusion 131 and the first arm 133 of other drive protrusion 131 located at an upper stream side, a communicated gap part 138 is formed.

As shown in FIG. 10, aright end part of the coil spring 107 comes into contact with the spring contact face 121 of the driving member 105. A left end part of the coil spring 107 is inserted in a space between the inner tube 123 and outer tube 124 of the moving member 106 and comes into contact with the spring reception 125 of the moving member 106. Due to such a configuration, the coil spring 107 biases the moving member 106 to the left side.

The pressuring member 108 includes a cylinder-formed engaged tube part 140 and a connecting arm part 141 protruded forward from the circumference of the engaged tube part 140.

The engaged tube part 140 is rotatably attached around the circumference of the outer tube 124 of the moving member 106 so that its movement to the right side is restricted by the ring 128 of the moving member 106. Due to such a configuration, the pressuring member 108 can be relatively turned to the moving member 106 and move in the direction of the rotation axis A together with the moving member 106 in a body. The engaged tube part 140 is inserted into the inside of the insertion tube 112 provided in the left side plate 110 of the casing member 103. On the circumference of the engaged tube part 140, engaging ribs 142 are formed below the connecting arm part 141 and at an opposite side of the connecting arm part 141.

On the proximal end part of the connecting arm part 141, a cylinder-formed first withdrawal boss 143 is protruded to the left side. On the distal end part of the connecting arm part 141, a cylinder-formed second withdrawal boss 144 is protruded to the left side. As shown in FIG. 7, the first withdrawal boss 143 penetrates through the first insertion hole 114 formed in the left side plate 110 of the casing member 103 and is protruded from the left side plate 110 to the left side. The second withdrawal boss 144 penetrates through the second insertion hole 115 formed in the left side plate 110 of the casing member 103 and is protruded from the left side plate 110 to the left side.

In the aforementioned configuration, a method of linking the drive coupling 126 to the following coupling 72 will be described as follows.

First, when the toner container 6 is taken down to the installed part 96 of the development device 12 for the installation, the transmitting member 27 of the toner container 6 pressures the first withdrawal boss 143 and second withdrawal boss 144 of the pressuring member 108 downward. According to this pressure, the pressuring member 108 is turned downward and moved to the right side and the pressuring member 108 pressures the moving member 106 to the right side. By this pressure, the moving member 106 is moved to the right side against a bias force of the coil spring 107. Accordingly, the drive coupling 126 is moved to the right side along the direction of the rotation axis A and withdrawn in the casing member 103 (refer to two-dot chain line in FIG. 7). In addition, when the toner container 6 is taken down to the installed part 96 of the development device 12 as mentioned above, the following coupling 72 of the toner container 6 goes down to face to the drive coupling 126. In such a situation, because the second withdrawal boss 144 of the pressuring member 108 is stopped in an engaged state by the protruding piece 66 of the lever 26, the upward turn of the pressuring member 108 is restricted.

When the installation of the toner container 6 to the installed part 96 of the development device 12 is completed as mentioned above, the worker, such as a user or a serviceman, may tilt the gripper 65 of the lever 26 backward. In such an operation of the lever 26, the engaged stop of the second withdrawal boss 144 by the protruding piece 66 of the lever 26 is released and the upward turn of the pressuring member 108 is allowed. Therefore, by the bias force of the coil spring 107, the pressuring member 108 is turned upward.

In conjunction with this, by the bias force of the coil spring 107, the moving member 106 is moved to the left side. Accompanying to this, the drive coupling 126 is moved to the left side along the direction of the rotation axis A and protruded from the casing member 103 (refer a solid line in FIG. 7). Accordingly, the drive coupling 126 is linked to the following coupling 72.

Next, in the aforementioned configuration, a method of supplying the toner from the toner container 6 to the photosensitive drum 10 will be described.

When the toner container 6 is taken down to the installed part 96 of the development device 12 as mentioned above, the pressuring protrusion 88 of the case side shutter 28 comes into contact with the development device side shutter 100. In such a situation, when the gripper 65 of the lever 26 is tilted backward to make the case side shutter 28 turned as mentioned above, as shown in FIG. 3, the case side shutter 28 moves to a position to open the discharge port 32 of the case main body 22.

Accompanying to the above-mentioned turn of the case side shutter 28, as shown in FIG. 3, the pressuring protrusion 88 of the case side shutter 28 pressures the development device side shutter 100 backward. In accordance with the pressure, the development device side shutter 100 is turned backwards around the supporting pivot 101, and then, the development device side shutter 100 opens the replenishment port 97 of the development device main body 91.

In this situation, when the motor 104 of the drive mechanism 102 is rotated, this rotation is transmitted to the moving member 106 via the worm gear 116, idle gear 118 and driving member 105, and then, the moving member 106 is rotated. When the moving member 106 thus rotates, this rotation is transmitted to the transmitting member 27 via the drive coupling 126 and following coupling 72, and then, the transmitting member 27 is rotated. When the transmitting member 27 thus rotates, the agitating paddle 24 connected to the transmitting member 27 is rotated, and then, the toner in the case main body 22 is conveyed to the side of conveying screw 23 with being agitated. In addition, when the transmitting member 27 rotates as mentioned above, this rotation is transmitted to the screw shaft 52 of conveying screw 23 via the transmission gear 71 and conveying gear 54, and then, the conveying screw 23 is rotated. Accompanying to this, the toner in the case main body 22 is discharged from the discharge port 32, and then, introduced in the inside of the development device main body 91 via the replenishment port 97. The toner introduced in the inside of the development device main body 91 is agitated by each agitating member 93, conveyed to the developing roller 94 and supplied from the developing roller 94 to the photosensitive drum 10.

Next, an action transmitting the rotation from the drive coupling 126 to the following coupling 72 when supplying the toner from the toner container 6 to the photosensitive drum 10 as mentioned above will be described with reference to FIG. 12.

When the drive coupling 126 and following coupling 72 are linked to each other, the extended part 77 of each following protrusion 74 of the following coupling 72 is inserted in each communicated gap part 138 of the drive coupling 126. In addition, the bend part 78 of each following protrusion 74 of the following coupling 72 is inserted in each depressed part 137 of the drive coupling 126.

In such a situation, when the drive coupling 126 is rotated by the motor 104, the pressuring part 136 provided in each drive protrusion 131 of the drive coupling 126 pressures the pressured part 80 provided in each following protrusion 74 of the following coupling 72. Accompanying to this, the drive coupling 126 and following coupling 72 are rotated in the same rotation direction B around the same rotation axis A. At that moment, the pressuring part 136 and pressured part 80 come into point contact with each other in a view of the direction of the rotation axis A.

At this moment, the pressuring part 136 pressures the pressured part 80, and thereby, in a contact part of the pressuring part 136 and pressured part 80, a force in a direction indicated by an arrow F in FIG. 12 is generated. This force can be divided into a component force f1 toward a side of the rotation axis A and another component force f2 perpendicular to this component force f1 toward a lower stream side in the rotation direction. By an effect of the above-mentioned component force f1, the drive coupling 126 is rotated with being drawn into the side of the rotation axis A.

In the embodiment, as mentioned above, when the pressuring part 136 pressures the pressured part 80, a force drawing the drive coupling 126 into the side of the rotation axis A is generated as the component force. Therefore, even if a drive torque of the following coupling 72 is large, it is possible to prevent the linkage of the drive coupling 126 and following coupling 72 from being accidentally released. Moreover, in comparison with cases forming the following coupling 72 and drive coupling 126 (hereinafter, called as couplings 72 and 126) in twisted-shapes and forming the couplings 72 and 126 to have tapered faces, it is possible to simplify the shapes of the couplings 72 and 126. Therefore, it is possible to simplify mold designs for molding the couplings 72 and 126. As a result, in a case where it is desired to provide incompatibility of the couplings 72 and 126 or other cases, it is possible to mold the couplings 72 and 126 in various shapes with maintaining the simple mold design.

The projection height of the flange 75 from the supporting face 73 is equal to the projection height of the following protrusion 74 from the supporting face 73. Therefore, it is possible to protect the following protrusion 74 by the flange 75 and to surely prevent breakage of the following protrusion 74. In another embodiment, the projection height of the flange 75 from the supporting face 73 may be more than the projection height of the following protrusion 74 from the supporting face 73 and, also in such a case, the similar effect can be obtained.

The following protrusion 74 includes the bend part 78 bent from the one end part in the longitudinal direction of the extended part 77 to the lower stream side in the rotation direction B. Therefore, it is possible to enhance strength of the following protrusion 74 and to more surely prevent the breakage of the following protrusion 74.

The pressuring part 136 of the drive coupling 126 is formed in the boundary part between the first arm part 133 and second arm part 134. Therefore, it is possible to enhance strength of the drive protrusion 131 and to surely prevent breakage of the drive protrusion 131.

The drive coupling 126 is provided movably along the direction of the rotation axis A. Therefore, even if an installing direction of the toner container 6 to the development device 12 is perpendicular to the direction of the rotation axis A, it is possible to link the drive coupling 126 to the following coupling 72. On the other hand, in a case applying such a configuration, if the drive coupling 126 were moved along the above-mentioned direction of the rotation axis A, there is a possibility that the linkage of the drive coupling 126 and following coupling 72 is accidentally released. Therefore, it is preferable to apply the configuration of the present disclosure, and then, to prevent the linkage of the drive coupling 126 and following coupling 72 from being accidentally released.

The pressuring part 136 and pressured part 80 are provided so as to come into point contact with each other in a view of the direction of the rotation axis A when the pressuring part 136 pressures the pressured part 80. Therefore, in comparison with a case where the pressuring part 136 and pressured part 80 come into line contact with each other in a view of the direction of the rotation axis A, the force toward the side of the rotation axis A when the pressuring part 136 pressures the pressured part 80 is easily generated. As a result, it is possible to more surely link the drive coupling 126 to the following coupling 72.

A plurality of the pressuring parts 136 and a plurality of the pressured parts 80 are provided at intervals of equal angle. Therefore, when the pressuring parts 136 pressure the pressured parts 80, it is possible to generate the force toward the side of the rotation axis A for each component in the drive coupling 126 and following coupling 72 in a well-balanced manner.

The toner container 6 includes the agitating paddle 24 and conveying screw 23. Therefore, it is possible to surely rotate the agitating paddle 24 and conveying screw 23 by a drive force of the motor 104, and then, to discharge the toner from the toner container 6.

Figure 13:
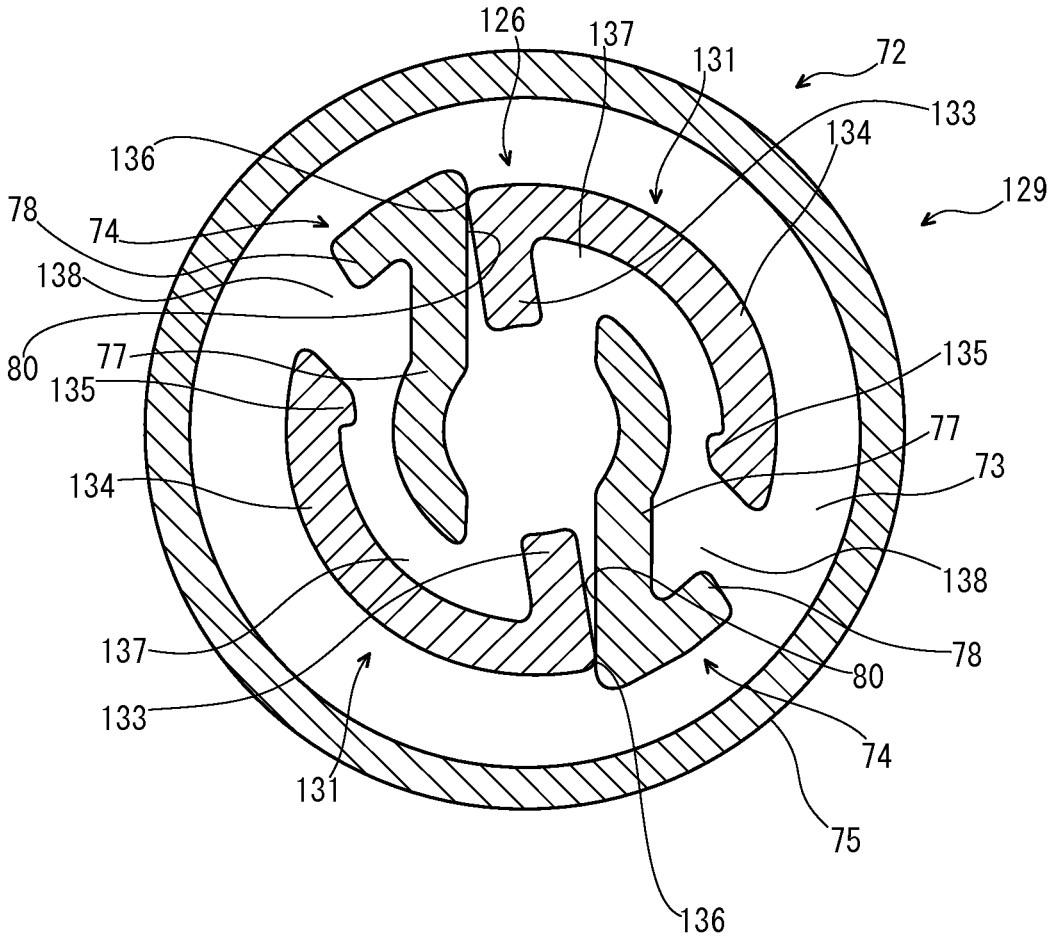
FIG. 13 is a sectional view showing a printer in a situation, in which a drive coupling is linked to a following coupling, according to another embodiment of the present disclosure.

Although, in the embodiment, three drive protrusions 131 and three following protrusions 74 are provided, in another embodiment, as shown in FIG. 13, two drive protrusions 131 and two following protrusions 74 may be provided. Alternatively, not particularly shown in the figure, four or more drive protrusions 131 and four or more following protrusions 74 may be provided. Although, in the embodiment, the bend part 78 is provided on the inside end part of the extended part 77 of the following protrusion 74, in another embodiment, as shown in FIG. 13, the bend part 78 is provided on an outside end part of the extended part 77 of the following protrusion 74. Although, in the embodiment, the extended part 77 of the following protrusion 74 is formed in a linear shape, in another embodiment, as shown in FIG. 13, the extended part 77 of the following protrusion 74 may be partly bent in an arc form. Thus, it is possible to optionally vary the forms of the drive coupling 126 and following coupling 72.

In addition, the image forming apparatus may configured that the forms of the drive coupling 126 and following coupling 72 are changed according to an apparatus model, a toner color or a destination and, if the toner container 6 being consistent in the apparatus model, toner color or destination is attached to the development device 12, the linkage of the drive coupling 126 and following coupling 72 becomes possible. By applying such a configuration, it is possible to prompt a user to attach the suitable toner container 5 being consistent in the apparatus model, toner color or destination to the development device 12.

In the embodiment, a case of attaching/detaching the toner container 6 to the development device 12 in a perpendicular direction to the direction of the rotation axis A was described. On the other hand, in another embodiment, the toner container 6 may be attached/detached to the development device 12 in a direction along the direction of the rotation axis A.

In the embodiment, the drive transmission mechanism 129 including the drive coupling 126 and following coupling 72 is used for drive transmission to the toner container 6. On the other hand, in another embodiment, the drive transmission mechanism 129 may be used for drive transmission to the photosensitive drum 10 or other member except for the toner container 6.

In the embodiment, the configuration of the present disclosure is applied to the toner container 6. On the other hand, in another embodiment, the configuration of the disclosure may be applied to another toner case (so-called "an intermediate hopper") interposed between the toner container 6 and development device 12.

The embodiment was described in a case of using the development device 12 as the installed member. On the other hand, in another embodiment, the printer main body 2 may be used as the installed member.

The embodiment was described in a case of applying the configuration of the present disclosure to the printer 1. On the other hand, in another embodiment, the configuration of the disclosure may be applied to another image forming apparatus except the printer 1, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A drive transmission mechanism provided in an image forming apparatus comprising:

a following coupling connected to one or more rotating members and configured to have a pressured part; and a drive coupling linked to the following coupling and configured to have a pressuring part, the drive coupling and following coupling are rotated in the same rotation direction around the same rotation axis by pressuring the pressured part by the pressuring part, and the pressured part is provided so as to come close to the rotation axis from an upper stream side to a lower stream side in the rotation direction.

2. An image forming apparatus comprising:

a toner case containing a toner, wherein the toner case includes:

a case main body having a discharge port discharging the toner;

one or more rotating members rotatably installed in the case main body; and a following coupling connected to the rotating member and configured to have a pressured part, an installed member in which the toner case is attachably/detachably installed, wherein the installed member includes:

a drive coupling linked to the following coupling and configured to have a pressuring part; and a drive source rotating the drive coupling, the drive coupling and following coupling are rotated in the same rotation direction around the same rotation axis by pressuring the pressured part by the pressuring part, and the pressured part is provided so as to come close to the rotation axis from an upper stream side to a lower stream side in the rotation direction.

3. The image forming apparatus according to claim 2, wherein the drive coupling and following coupling are provided in forms changed according to an apparatus model, a toner color or a destination, and the linkage of the drive coupling to the following coupling becomes possible, if the toner case being consistent in the apparatus model, toner color or destination is attached to the installed member.

4. The image forming apparatus according to claim 2, wherein the following coupling includes:

a supporting face provided perpendicular to the rotation axis;

a following protrusion protruded from the supporting face and forming the pressured part; and a flange protruded from the supporting face and surrounding the following protrusion, and projection height of the flange from the supporting face is equal to or more than projection height of the following protrusion from the supporting face.

5. The image forming apparatus according to claim 4, wherein the following protrusion includes:

an extended part forming the pressured part; and a bend part bent from one end part in the longitudinal direction of the extended part to a lower stream side in the rotation direction.

6. The image forming apparatus according to claim 2, wherein the drive coupling includes:

a flat face provided perpendicular to the rotation axis; and a drive protrusion protruded from the flat face, the drive protrusion includes:

a first arm part extending in a radial direction around the rotation axis; and a second arm part bent from an end part on the outside in the radial direction of the first arm part to an upper stream side in the rotation direction, and the pressuring part is formed in a boundary part between the first arm part and second arm part.

7. The image forming apparatus according to claim 2, wherein the drive coupling is provided movably along a direction of the rotation axis.

8. The image forming apparatus according to claim 2, wherein the pressuring part and pressured part are provided so as to come into point contact with each other in a view of a direction of the rotation axis when the pressuring part pressures the pressured part.

9. The image forming apparatus according to claim 2, wherein a plurality of the pressuring parts and a plurality of the pressured parts are respectively provided at intervals of equal angle.

10. The image forming apparatus according to claim 2, wherein the rotating members include:

an agitating paddle agitating the toner contained in the toner case; and a conveying screw discharging the toner agitated by the agitating paddle from the discharge port.

11. A toner case containing a toner, which is attachably/detachably installed in an installed member so as to be provided in an image forming apparatus together with the installed member, comprising:

a case main body having a discharge port discharging the toner;

one or more rotating members rotatably installed in the case main body; and a following coupling connected to the rotating member and configured to have a pressured part, wherein the installed member includes:

a drive coupling linked to the following coupling and configured to have a pressuring part; and a drive source rotating the drive coupling, the drive coupling and following coupling are rotated in the same rotation direction around the same rotation axis by pressuring the pressured part by the pressuring part, and the pressured part is provided so as to come close to the rotation axis from an upper stream side to a lower stream side in the rotation direction.

12. The toner case according to claim 11, wherein the drive coupling and following coupling are provided in forms changed according to an apparatus model, a toner color or a destination, and the linkage of the drive coupling to the following coupling becomes possible, if the toner case being consistent in the apparatus model, toner color or destination is attached to the installed member.

13. The toner case according to claim 11, wherein the following coupling includes:

a supporting face provided perpendicular to the rotation axis;

a following protrusion protruded from the supporting face and forming the pressured part; and a flange protruded from the supporting face and surrounding the following protrusion, and projection height of the flange from the supporting face is equal to or more than projection height of the following protrusion from the supporting face.

14. The toner case according to claim 13, wherein the following protrusion includes:

an extended part forming the pressured part; and a bend part bent from one end part in the longitudinal direction of the extended part to a lower stream side in the rotation direction.

15. The toner case according to claim 11, wherein the drive coupling includes:

a flat face provided perpendicular to the rotation axis; and a drive protrusion protruded from the flat face, the drive protrusion includes:

a first arm part extending in a radial direction around the rotation axis; and a second arm part bent from an end part on the outside in the radial direction of the first arm part to an upper stream side in the rotation direction, and the pressuring part is formed in a boundary part between the first arm part and second arm part.

16. The toner case according to claim 11, wherein the drive coupling is provided movably along a direction of the rotation axis.

17. The toner case according to claim 11, wherein the pressuring part and pressured part are provided so as to come into point contact with each other in a view of a direction of the rotation axis when the pressuring part pressures the pressured part.

18. The toner case according to claim 11, wherein a plurality of the pressuring parts and a plurality of the pressured parts are respectively provided at intervals of equal angle.

19. The toner case according to claim 11, wherein the rotating members include:

an agitating paddle agitating the toner contained in the toner case; and a conveying screw discharging the toner agitated by the agitating paddle from the discharge port.

* * * * *